US008391764B2

(12) United States Patent
Tanaka et al.

(10) Patent No.: US 8,391,764 B2
(45) Date of Patent: Mar. 5, 2013

(54) FIXING DEVICE INCLUDING ENDLESS FIXING BELT, HEATING MEMBER AND TENSION ROLLER

(75) Inventors: Atsushi Tanaka, Osaka (JP); Shinji Yamana, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 99 days.

(21) Appl. No.: 13/053,545

(22) Filed: Mar. 22, 2011

(65) Prior Publication Data

US 2011/0236089 A1 Sep. 29, 2011

(30) Foreign Application Priority Data

Mar. 29, 2010 (JP) ..... 2010-075138

(51) Int. Cl.
*G03G 15/20* (2006.01)

(52) U.S. Cl. ..... 399/329

(58) Field of Classification Search ..... 399/328, 399/329, 335; 219/216
See application file for complete search history.

(56) References Cited

U.S. PATENT DOCUMENTS 5,832,353 A * 11/1998 Sano ..... 399/329
6,243,559 B1 6/2001 Kurotaka et al.
6,836,637 B2 * 12/2004 Kelsay ..... 399/330
7,313,353 B2 * 12/2007 Satoh et al. ..... 399/329
7,509,085 B2 * 3/2009 Yoshinaga et al. ..... 399/325
7,769,333 B2 * 8/2010 Shin et al. ..... 399/329
8,107,868 B2 * 1/2012 Kimura ..... 399/329
2009/0136273 A1 5/2009 Kobayashi
2009/0136274 A1 * 5/2009 Kobayashi ..... 399/329
2009/0269108 A1 10/2009 Condello et al.

FOREIGN PATENT DOCUMENTS

JP 10-307496 A 11/1998
JP 2002333788 A * 11/2002
JP 2003-122179 A 4/2003
JP 2004021081 A * 1/2004
JP 2004055395 A * 2/2004
JP 2004184607 A * 7/2004
JP 2005-128337 A 5/2005
JP 2009-128690 A 6/2009
JP 2009-265669 A 11/2009

* cited by examiner

*Primary Examiner* — Robert Beatty
(74) *Attorney, Agent, or Firm* — Renner, Otto, Boisselle & Sklar, LLP

(57) ABSTRACT

Disclosed is a fixing device including: a fixing belt provided across a fuser roller and a heating member in a tensioned state, which fixing belt is rotated; and a tension roller applying a load on the fixing belt from an inner circumferential side of the fixing belt, which tension roller is determined in position on the fixing belt so that a length of the fixing belt upstream of the fixing nip area in a fixing belt rotating direction, from the tension roller to the fixing member, is longer than that downstream of the fixing nip area in the fixing belt rotating direction, from the fixing member to the tension roller.

8 Claims, 5 Drawing Sheets

FIXING DEVICE INCLUDING ENDLESS FIXING BELT, HEATING MEMBER AND TENSION ROLLER

This Nonprovisional application claims priority under 35 U.S.C. §119(a) on Patent Application No. 2010-075138 filed in Japan on Mar. 29, 2010, the entire contents of which are hereby incorporated by reference.

TECHNICAL FIELD

The present invention relates to a fixing device used in an image forming apparatus of an electrophotographic printing method, and relates to an image forming apparatus including such a fixing device.

BACKGROUND ART

As fixing devices used in image forming apparatuses of an electrophotographic printing method for instance copying machines and printers, fixing devices of a heat roller fusing method have been frequently used. The fixing device of the heat roller fusing method includes: a pair of rollers (fuser roller and pressure roller) that are pressured against each other; and heating means made up of a halogen heater or the like, provided inside either both or one of the pair of rollers. After the heating means heats the pair of rollers to a set temperature (fixing temperature), a sheet (recording paper, recording sheet) on which an unfixed toner image is formed is fed to a pressure area (fixing nip area) of the pair of rollers; by causing the sheet to pass through the pressure area, the toner image is fused by the heat and pressure.

It is generally the case that in a fixing device provided in a color image forming apparatus, an elastic roller is used, which elastic roller is a fuser roller on which an elastic layer made of silicon rubber or the like is provided as its outermost layer. By having the fuser roller be an elastic roller, the surface of the fuser roller elastically changes in shape in accordance with an uneven surface of an unfixed toner image that comes in contact with the toner image, so as to cover up the toner image surface. This allows fusing, in a good manner, of a colored unfixed toner image which is greater in toner amount as compared to a black-and-white unfixed toner image.

Moreover, due to a warp-releasing effect of the elastic layer at the fixing nip area, it is possible to improve releasability of color toner that becomes more easily offset as compared to black-and-white toner. Furthermore, the nipping part in the fixing nip area has its top side (the fuser roller) protruding (what is called, reverse-nip shape), thereby improving the releasing property of the sheet. As a result, it is possible to release the sheet without using releasing means such as a releasing nail or the like (self-stripping). This overcomes the generation of an image defect caused by the releasing means.

In order to correspond to the speeding up of processing speed, it is necessary for the fixing device provided in such a color image forming apparatus to have a wide nip width in the fixing nip area. Examples of means for widening the nip width encompass: a method of thickening the elastic layer of the fuser roller; and a method of broadening a diameter of the fuser roller.

However, since the thermal conductivity of the elastic layer is extremely low, if heating means is provided as in the conventional fuser roller, inside the fuser roller which has the thickened elastic layer, this would result in insufficient heat supply in the case where the processing speed is sped up. As a result, a problem arises that the temperature of the fuser roller cannot keep up with the processing speed. On the other hand, if the diameter of the fuser roller is broadened, problems arise such as that more time is necessary to warm up the fuser roller and that the electricity consumption increases in amount.

In order to solve these problems, a fixing device of a belt fixing method (belt fixing device) such as one disclosed in Patent Literature 1 for example has been used in recent years as a fixing device provided in the color image forming apparatuses. The belt fixing device provides a heat roller externally of the fixing roller and provides a fixing belt across the fuser roller and the heat roller; the fuser roller and pressure roller are pressured against each other with the fixing belt being sandwiched between the fuser roller and the pressure roller.

The belt fixing device heats a fixing belt that has a small heat capacity, so it is therefore possible to shorten the time required for warming up. Moreover, no heat source such as a halogen lamp needs to be built in the fuser roller; this allows providing an elastic layer of a low hardness made of sponge rubber or the like, thereby making it possible to have a broad nip width.

CITATION LIST

Patent Literature

Patent Literature 1
Japanese Patent Application, Tokukaihei, No. 10-307496 A (Publication Date: Nov. 17, 1998)

SUMMARY OF INVENTION

Technical Problem

However, the conventional belt fixing device has the following problems. In the configuration of the conventional belt fixing device, the heat roller is to mainly serve as a tensioning function to provide the fixing belt in a tensioned state; accordingly, the heat roller requires to have enough strength to overcome the problem of flexure or warp when load is applied on the heat roller. As a result, it is required to take measures to the heat roller, such as broadening the diameter of the heat roller or thickening the thickness of the heat roller. However, these cases would cause a problem that the heat capacity of the heat roller increases, thereby causing a decrease in heating efficiency.

On this account, the present invention is accomplished in view of the conventional problems, and its object is to provide a fixing device that has excellent heat efficiency while achieving reduction in driving torque of a fixing belt and reduction in damage given to the fixing belt.

Solution to Problem

In order to attain the object, a fixing device of the present invention includes: a rotatable fixing member; a heating member; an endless fixing belt, provided across the fixing member and the heating member in a tensioned state, the fixing belt (i) being rotated and (ii) being heated by the heating member; a pressure member being pressed against the fixing member while having the fixing belt be sandwiched between the pressure member and the fixing member, to form a fixing nip area at this pressured region together with the fixing belt, the fixing device fixing onto a recording material that passes through the fixing nip area an unfixed image formed on the recording material; and a tension roller applying a load on the fixing belt from an inner circumferential side of the fixing belt, the tension roller being determined in position on the fixing belt so that a length of the fixing belt upstream of the fixing nip area in a fixing belt rotating direction, from the tension roller to the fixing member, is longer than that downstream of the fixing nip area in the fixing belt rotating direction, from the fixing member to the tension roller. In other words, the fixing belt provided across the fixing member and the tension roller is longer in length on its upstream side with respect to the fixing nip area in a fixing belt rotating direction than that of its downstream side with respect to the fixing nip area in the fixing belt rotating direction.

Advantageous Effects of Invention

According to the configuration of the present invention, the fixing belt is provided across a fixing member, a heating member, and a tension roller, in a tensioned state. Hence, it is possible to reduce the driving torque of the fixing belt as well as reducing any damage given to the fixing belt. Moreover, the tension roller is determined in position on the fixing belt so that a length of the fixing belt upstream of the fixing nip area in a fixing belt rotating direction, from the tension roller to the fixing member, is longer than that downstream of the fixing nip area in the fixing belt rotating direction, from the fixing member to the tension roller. This provides a space to dispose the heating member on the upstream side of the fixing nip area. As a result, it is possible to have a wide heating nip width. Moreover, by having the downstream side in the fixing belt rotating direction be shorter than the upstream side in the fixing belt rotating direction, a distance in which the fixing belt is cooled is made short. As a result, it is possible to prevent the dispersion of heat, thereby allowing more efficient heating of the fixing belt.

As described above, the fixing device having the foregoing configuration attains excellent heat efficiency and low electricity consumption while preventing occurrence of poor fixing. Moreover, this configuration achieves the reduction in the driving torque of the fixing belt and reduction in damage given to the fixing belt.

Moreover, the fixing belt is put across the heating member in a tensioned state. That is, the heating member is in contact with the fixing belt from an inner side of the fixing belt. As a result, this prevents the generation of scratches caused by rubbing, on an outer circumferential surface of the fixing belt that directly is in contact with the unfixed image on the recording material.

BRIEF DESCRIPTION OF DRAWINGS

FIG. 5(*b*) is a view illustrating a fixing device in which a length of a fixing belt upstream of a fixing nip area in a fixing belt rotating direction, from a tension roller to a fixing member, is the same as that downstream of the fixing nip area in the fixing belt rotating direction, from the fixing member to the tension roller.

DESCRIPTION OF EMBODIMENTS

One embodiment of the present invention is described below with reference to drawings. The following description explains in details of one embodiment of a fixing device according to the present invention and an image forming apparatus including that fixing device.

(Image Forming Apparatus)

Figure 1:
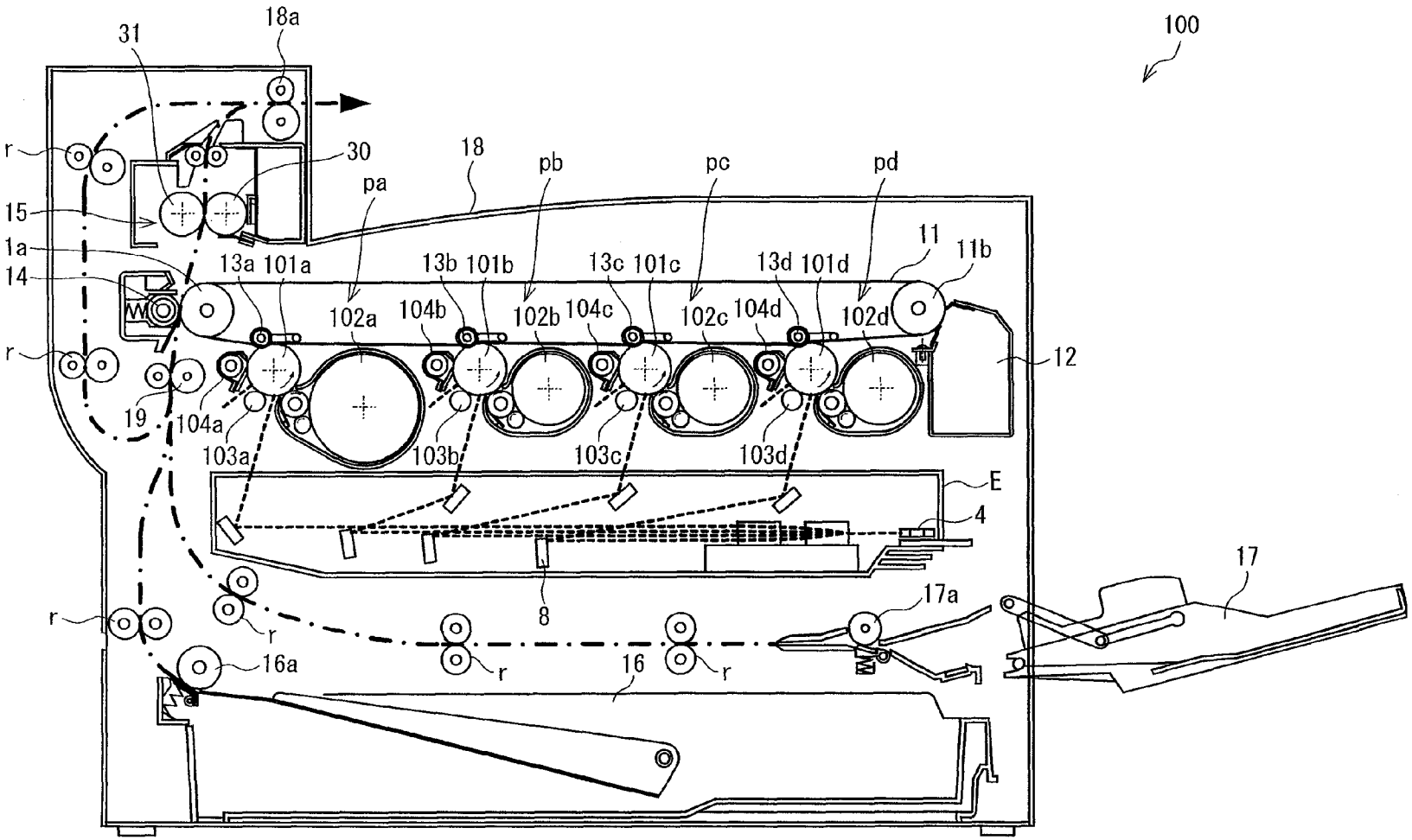
FIG. 1 is a view schematically illustrating a configuration of an image forming apparatus of one embodiment of the present invention.

First described is a configuration of an image forming apparatus of the present embodiment. FIG. 1 is a cross-sectional view schematically illustrating a configuration of an image forming apparatus 100 of the present embodiment. The image forming apparatus 100 is what is called a tandem, color multi-functional peripheral of an intermediate transfer method, which is capable of forming a full color image. Although the present embodiment describes the image forming apparatus according to the present invention as applicable to color multi-functional peripherals (or copying machines) and color printers, the image forming apparatus according to the present invention is also applicable to black-and-white multi-functional peripherals (or copying machines) and black-and-white printers.

As illustrated in FIG. 1, the image forming apparatus 100 includes: an optical system unit E; four sets of visible-image forming units pa, pb, pc, pd; an intermediate transfer belt 11; a second transfer unit 14; a fixing unit (fixing device) 15; an inner paper feeding unit 16; and a manually-fed paper feeding unit 17.

In the visible-image forming unit pa, a charging unit (charging device) 103*a*, a developing unit 102*a*, and a cleaning unit 104*a* are provided around a photoreceptor 101*a* that serves as a toner image carrier. A first transfer unit 13*a* is provided so that the intermediate transfer belt 11 is sandwiched between the first transfer unit 13*a* and the photoreceptor 101*a*. The other three sets of visible-image forming units pb, pc, and pd have similar configurations as the visible-image forming unit pa; identical constituents are provided with a reference sign of a same number however with an alphabet letter (b, c, d) corresponding to its respective visible-image forming unit. The visible-image forming units pa, pb, pc, and pd contain toners of colors yellow (Y), magenta (M), cyan (C), and black (B), respectively.

The optical system unit E is provided in such a manner that data from a light source 4 reaches the four sets of photoreceptors 101*a*, 101*b*, 101*c*, and 101*d*. The optical system unit E is configured so that pixel signals of image data corresponding to yellow components, magenta components, cyan components, and black components are received. Based on these received image signals, beams are emitted from the light source 4 and are reflected at respective mirrors 8, to expose the charged photoreceptors 101*a*, 101*b*, 101*c*, and 101*d* with the beams, respectively, to form an electrostatic latent image.

The intermediate transfer belt 11 is provided in a tensioned state by use of tension rollers 11*a* and 11*b*. Moreover, a waste toner BOX 12 collecting toner remaining on the intermediate transfer belt 11 is disposed on a side of the intermediate transfer belt 11 on which the tension roller 11*b* is provided, and the second transfer unit 14 is disposed on a side of the intermediate transfer belt 11 on which the tension roller 11*a* is provided. The waste toner BOX 12 and the second transfer unit 14 are both provided in contact with the intermediate transfer belt 11.

The fixing unit 15 is a device that causes an unfixed toner image formed on a surface of a recording paper to be fixed on the recording paper P by heat and pressure. The fixing unit 15 includes a fuser roller 30 and a pressure roller 31, and these rollers are pressured against each other at a set pressure by pressure means not illustrated. The fixing unit 15 is disposed downstream of the second transfer unit 14. The present embodiment includes, as the fixing unit 15, a fixing device of a sheet-shaped heating belt fixing method; details thereof are described later.

How an image is formed with the image forming apparatus 100 is as follows. A surface of the photoreceptor 101*a* is evenly charged by use of the charging unit 103*a*, and thereafter, the surface of the photoreceptor 101*a* is exposed to laser light by use of the optical system unit E in accordance with image information, to form an electrostatic latent image. The charging unit 103*a* of the present embodiment employs a charging roller method to evenly charge the surface of the photoreceptor 101*a* while holding down the generation of ozone when charging. Subsequently, the developing unit 102*a* develops a toner image from the electrostatic latent image formed on the photoreceptor 101*a*, and this toner image made visible is transferred onto the intermediate transfer belt 11 by use of the first transfer unit 13*a* to which a bias voltage of a polarity reverse to the toner is applied.

The other three sets of visible-image forming units pb, pc, pd also are operated in a similar manner, and successively transfer a toner image onto the intermediate transfer belt 11. The toner image transferred onto the intermediate transfer belt 11 is conveyed to the second transfer unit 14. Meanwhile, recording paper fed from a paper feeding roller 16*a* of an inner paper feeding unit 16 or fed from a paper feeding roller 17*a* of a manually-fed paper feeding unit 17 is separately conveyed to the second transfer unit 14 by conveying rollers r and 19, and a bias voltage of a polarity reverse of the toner is applied to the recording paper to transfer the toner image onto the recording paper. The recording paper on which the toner image is transferred is conveyed to the fixing unit 15, and is sufficiently heated and applied with pressure while passing through the fixing unit 15 to fuse the toner image onto the recording paper. Thereafter, the recording paper on which the toner image is fixed is discharged outside.

(Fixing Device)

Figure 2:
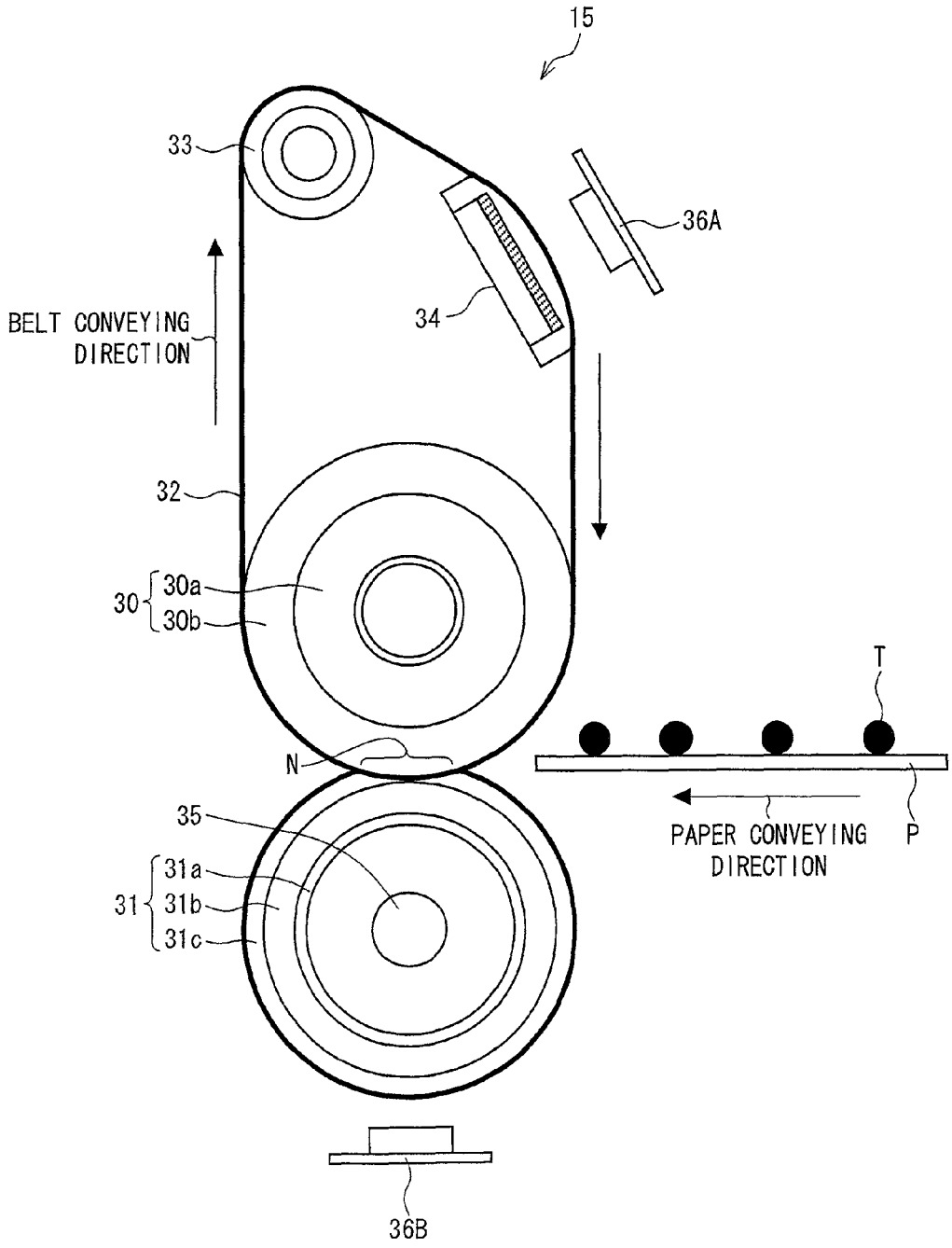
FIG. 2 is a cross-sectional view schematically illustrating a configuration of a fixing device of one embodiment of the present invention.
Figure 3:
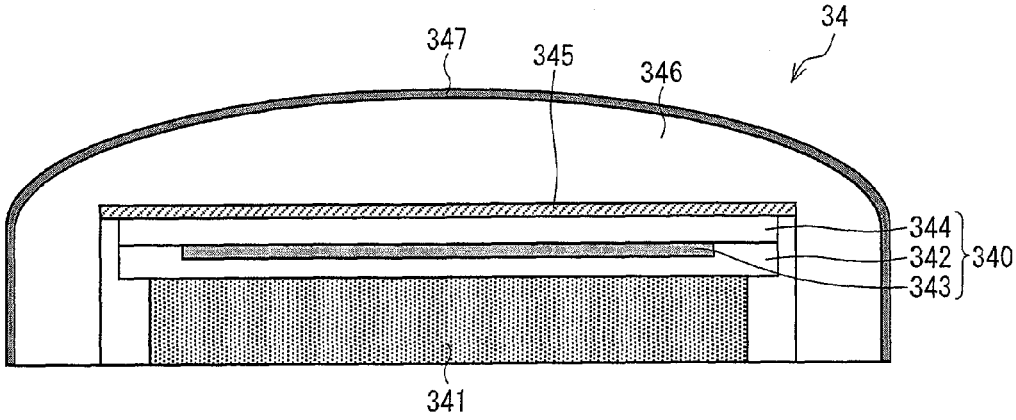
FIG. 3 is a cross-sectional view schematically illustrating a heating member provided in the fixing device.

Next described is a configuration of the fixing unit (fixing device) 15 of the present embodiment, with reference to FIGS. 2 and 3. FIG. 2 is a cross-sectional view illustrating the configuration of the fixing unit 15, and FIG. 3 is a cross-sectional view illustrating a configuration of a heating member 34 included in the fixing unit 15.

As illustrated in FIG. 2, the fixing unit 15 includes: a fuser roller (fixing member) 30; a pressure roller (pressure member) 31; an endless fixing belt 32; a heating member 34 which tensions and heats the fixing belt 32; and further a tension roller 33 which applies load on the fixing belt from an inner circumferential side of the fixing belt. In addition, although not illustrated, the fixing unit 15 also includes a pressure spring which applies pressure to the fuser roller 30 and the pressure roller 31, and a pressurization release mechanism.

Moreover, the fixing unit 15 includes a heater lamp 35 which is a heat source for heating the pressure roller 31, and a thermistor 36A and thermistor 36B as temperature sensors serving as temperature detection means that detect temperatures of the fixing belt 32 and the pressure roller 31.

The fixing unit 15 is a unit that fuses an unfixed toner image (toner T) formed on a surface of a piece of recording paper (recording material, sheet material) P onto the recording paper P by use of heat and pressure. The fixing unit 15 of the present embodiment is a fixing device of a fixing method in which the heating member 34 disposed in contact with an inner circumferential surface of the fixing belt 32 heats the fixing belt 32, and this heated fixing belt 32 directly applies heat to the toner image on the recording paper P at the fixing nip area N. The unfixed toner image is formed by use of a toner T contained in, for instance, a non-magnetic single component developer (non-magnetic toner), a magnetic developer (magnetic toner), or a non-magnetic two component developer (non-magnetic toner and carrier).

The fuser roller 30 and pressure roller 31 are pressured against each other by use of the pressure spring not illustrated at a set load (e.g., 216N in the present embodiment). This forms a fixing nip area N (region in which the fuser roller 30 and the pressure roller 31 are pressured against each other) between the two rollers. Note that in the present embodiment, a nip width (width of the fixing nip area N in a recording paper carrying direction) is 7 mm, however the nip width is not limited to this. By conveying the recording paper P on which the unfixed toner image is formed to the fixing nip area N and causing the recording paper P to pass through the fixing nip area N, the toner image becomes fixed onto the recording paper P. While the recording paper P passes through the fixing nip area N, the fixing belt 32 is in contact with the recording paper P on its toner image forming surface, whereas the pressure roller 31 is in contact with the recording paper P on its side opposite of the toner image forming surface.

The fuser roller 30 forms the fixing nip area N with the pressure roller 31 by having the fixing belt 32 be sandwiched between the fuser roller 30 and the pressure roller 31 and having the fuser roller 30 and pressure roller 31 be pressured against each other. Furthermore, the fuser roller 30 also conveys the fixing belt 32 by driving the fixing belt 32 to rotate caused by friction resistance with the outer circumferential surface of the fixing belt 32. As the fuser roller 30, a roller of a double-layered structure, for example in which a core 30*a* and an elastic layer 30*b* are formed in this order, may be used. The core 30*a* is made of, for example, iron, stainless steel, aluminum, copper, or like metal, or an alloy of these metals. Moreover, the elastic layer 30*b* is suitably made of rubber material or like material which has heat resistance and which is elastically deformable, such as silicon rubber, fluoro rubber or like rubbers. In the present embodiment, the fuser roller 30 has a diameter of 30 mm; iron having a diameter of 20 mm is used as the core, and silicon sponge rubber having a thickness of 5 mm is used as the elastic layer. Note however that the present invention is not limited to these values and material.

As the pressure roller 31, a roller of a three-layered configuration, for example in which a core 31*a*, an elastic layer 31*b*, and a release layer 31*c* are formed in this order, may be used. The core 31*a* is made of, for example, iron, stainless steel, aluminum, copper, or like metal, or an alloy of these metals. The elastic layer 31*b* is made of rubber material or like material which has heat resistance, such as silicon rubber, fluoro rubber or like rubber. Moreover, the release layer 31*c* is suitably made of fluororesin such as PFA (copolymer of tetrafluoroethylene and perfluoroalkylvinylether) or PTFE (polytetrafluoroethylene). In the present embodiment, the pressure roller 31 has a diameter of 30 mm; iron (STKM) having a diameter of 28 mm and a thickness of 2 mm is used as the core 31*a*, silicon solid rubber having a thickness of 1 mm is used as the elastic layer 31*b*, and a PFA tube having a thickness of 30 μm is used as the release layer 31*c*.

Moreover, inside the pressure roller 31 is provided a heater lamp 35 made up of a halogen lamp or the like, which heats the pressure roller 31. By having a control circuit (not illustrated) supply electricity to (pass electricity through) the heater lamp 35 from a power circuit (not illustrated), the heater lamp 35 emits light, whereby infrared ray is radiated. The pressure roller 31 absorbs the infrared rays at its inner surface, which inner surface becomes heated by the infrared rays; this as a result heats the entire pressure roller 31. In the present embodiment, a heater lamp 35 having a rated electricity of 400 W is used. Moreover, in order to make the infrared rays radiated from the heater lamp 35 be absorbed more easily, the inner circumferential surface of the pressure roller 31 may be coated with a heat-resistant black coating which has good absorbing properties for a wave range of the infrared rays.

The fixing belt 32 is stretched across the fuser roller 30, the heating member 34, and further the tension roller 33, and is made to rotate in cooperation with the fuser roller 30 while the fuser roller 30 is rotated. The fixing belt 32 is heated to a set temperature by use of the heat generated by the heating member 34, to heat the recording paper P on which the unfixed toner image is formed, which recording paper P passes through the fixing nip area N.

Although not particularly illustrated, as the fixing belt 32, a fixing belt of a triple-layered structure may be used, in which a base material, an elastic layer, and a release layer are formed in this order. As the base material, a hollow cylindrical base material made of a heat-resistant resin such as a polyimide or metal material such as stainless steel or nickel may be used. As the elastic layer, an elastomer material (e.g., silicon rubber) having excellent heat resistance and elasticity may be used. As the release layer, a synthetic resin material (e.g., fluororesin such as PFA or PTFE) having excellent heat resistance and releasability may be used. The elastic layer and the release layer are formed on an outer circumferential side of the fixing belt 32. Furthermore, in a case where a heat-resistant resin such as polyimide is used as base material, it is more preferable to include fluororesin. By including fluororesin, it is possible to further reduce the frictional resistance with the heating member 34, and further reduce a sliding load of the heating member 34.

The fixing belt 32 of the present embodiment has a diameter of 50 mm; polyimide having a thickness of 50 μm is used as base material, silicon rubber having a thickness of 150 μm is used as the elastic layer, and a PFA tube having a thickness of 30 μm is used as the release layer. The release layer may coat not just the PFA tube but also PFA, PTFE and the like.

The tension roller 33 is provided to suspend the fixing belt 32 and be in contact with the inner circumferential surface of the fixing belt 32, and is held so that the tension roller 22 can apply a set load (tension) to the fixing belt 32. The tension roller 33 is configured of a core made of metal material, and its outer surface is coated with heat insulating material. For example, metal such as iron, stainless steel, aluminum, or copper, or an alloy of these metals is used for the core. Moreover, in order to hold down the heat from being released from the fixing belt 32, sponge, felt or like material is used as the heat insulating material that is coated on the outer sides of the core. In the present embodiment, the tension roller 33 has a diameter of 12 mm; iron having a diameter of 8 mm is used as the core, and silicon sponge rubber having a thickness of 2 mm is used as the heat insulating layer.

The heating member 34 is in contact with the fixing belt 32 and heats the fixing belt 32 to a set temperature. The heating member 34 is connected to a power source (not illustrated) that supplies a set electricity power to the heating member 34. The heating member 34 is in contact with the fixing belt 32 on the inner circumferential surface of the fixing belt 32, to suspend the fixing belt 32. The heating member 34 is formed in such a manner that its surface contacting with the fixing belt 32 is shaped of a circular arc. The heating member 34 is provided upstream of the fixing nip area N however downstream of the tension roller 33. Hence, the heat of the heating member 34 is efficiently conducted to the fixing nip area N.

The heating member 34, as illustrated in FIG. 3, includes a heat transfer member 346 and a sheet heating element (sheet heater) 340. Furthermore, the heating member 34 includes an elastic layer 341 and a well heat-conducting layer 345.

The heat transfer member 346 is disposed extending in a width direction of the fixing belt 32 (axis direction of the fuser roller) and being in contact with the fixing belt 32, and conducts heat generated by the sheet heating element 340 to the fixing belt 32. The material that makes up the heat transfer member 346 is not particularly limited, however it is preferable that the material be a metal material which has high thermal conductivity so that an even temperature distribution is attained at the heating nip where the heating member 34 (heat transfer member 346) and the fixing belt 32 are pressured against each other. This metal material may be iron, aluminum, copper, or like material, however it is also possible to use stainless steel. Moreover, with the heat transfer member 346, a coating layer 347 is formed on a surface of the heat transfer member 346 which is in contact with the fixing belt 32.

It is necessary to form the coating layer 347 with material that has thermal conductivity allowing heat generated by the sheet heating element 340 to be conducted to the fixing belt 32 via the heat transfer member 346 and that can be reduced in frictional force with the fixing belt 32. By having such a coating layer 347 formed, it is possible to conduct heat to the fixing belt 32 and to attain high durability by preventing abrasion of the fixing belt 32 which slides while being in contact with the heat transfer member 346. Moreover, since the frictional force with the fixing belt 32 can be reduced, it is also possible to reduce the load received by the fuser roller 30 and pressure roller 31 which drive the fixing belt 32, thereby ensuring the durability of the rollers and enabling driving of the rollers with less torque. Examples of material that make up the coating layer 347 encompass fluororesin such as PFA or PTFE. In the present embodiment, the coating layer 347 is a layer made of PTFE having a thickness of 20 μm.

The sheet heating element 340 includes a heating resistor 343 and insulators 342 and 344. The two insulators 342 and 344 are insulators of identical configurations, and the two insulators 342 and 344 sandwich the heating resistor 343. The heating resistor 343 and the insulators 342 and 344 extend in a longitudinal direction of the heat transfer member 346 (width direction of the fixing belt 32), and are formed in an inner side of the heat transfer member 346. The sheet heating element 340 has, on both its ends in the longitudinal direction, power supply terminal sections (not illustrated).

The insulators 342 and 344 are layers that are formed of material having both heat resistance and electrical insulating properties, and carries out insulation with respect to the heat transfer member 346 or space by being sandwiched between the heating resistor 343 and the heat transfer member 346 or by covering the heating resistor 343. By forming such insulators 342 and 344, it is possible to ensure insulation of the heating resistor 343 with the heat transfer member 346 or the space, and therefore can attain a safer heating member 34. Examples of material making up the insulators 342 and 344 encompass heat resistance polymer material such as polyimide resin, ceramics material such as alumina, and glass material. In the present embodiment, the insulators 342 and 344 are layers that are made of ceramics material, each having a thickness of 200 μm.

The heating resistor 343 is a layer that generates heat as a result of the power supply terminal section not illustrated being applied a voltage. In the present embodiment, the heating resistor 343 is a metallic resistor including metal material whose main component is nickel chrome or having a resistant component made of stainless steel, and has a thickness of 15 μm. Other than this, a heating resistor such as silver or gold, silver-palladium alloy or like material may also be used. Joule heat generates by causing electricity to pass through the heating resistor 343; this heats the fixing belt 32, via the insulator 344 and the heat transfer member 346.

The sheet heating element 340 including the heating resistor 343 and the insulators 342 and 344 is provided on a rear side of the heat transfer member 346 via a well heat-conducting layer 345 such as silicon grease, which well heat-conducting layer 345 is heat-resistant. Hence, the sheet heating element 340 is configured in such a manner that the heat transfer member 346, the well heat-conducting layer 345, the insulator 344, the heating resistor 343, and the insulator 342 are disposed in this order. Moreover, the insulator 342 is supported by the elastic layer 341. The elastic layer 341 requires having heat resistance of a high temperature range, and is formed by use of fluoro rubber, polyimide foam, or like material.

A surface of the heat transfer member 346 which surface is in contact with the inner circumferential surface of the fixing belt 32 is a surface curved so as to protrude outwards, and a flat surface on the opposite side of this curved surface supports the sheet heating element 340. This surface curved outwards makes it possible to bridge the fixing belt 32 while holding down the abrasion of the fixing belt 32, and allows to efficiently supply heat to the fixing belt 32 from the heating member 34. Furthermore, use of the sheet heating element 340 having a small heat capacity reduces the amount of electricity consumption.

Various materials may be used as the heating resistor 343; examples encompass: stainless steel, nickel-chrome alloy, and ceramic resistance heating material. Generally, the amount of electricity consumed by the fixing device among the entire image forming apparatus is large in proportion, and it is advantageous to reduce the amount of electricity consumption of the fixing device in order to reduce the amount of electricity consumption of the image forming apparatus.

As described above, the fixing unit 15 includes the tension roller 33 which applies a load to the fixing belt 32 from the inner circumferential side of the fixing belt 32. Further, the tension roller 33 is determined in position on the fixing belt 32 provided across the fuser roller 30 and the tension roller 33, so that a length of the fixing belt 32 upstream of the fixing nip area N in a fixing belt 32 rotating direction is longer than that downstream of the fixing nip area N in the fixing belt 32 rotating direction. That is to say, the fixing belt 32 is provided across the fuser roller 30, the heating member 34, and also the tension roller 33 in a tensioned state. This as a result reduces the driving torque of the fixing belt 32 and reduces the damage given to the fixing belt 32.

Figure 5:
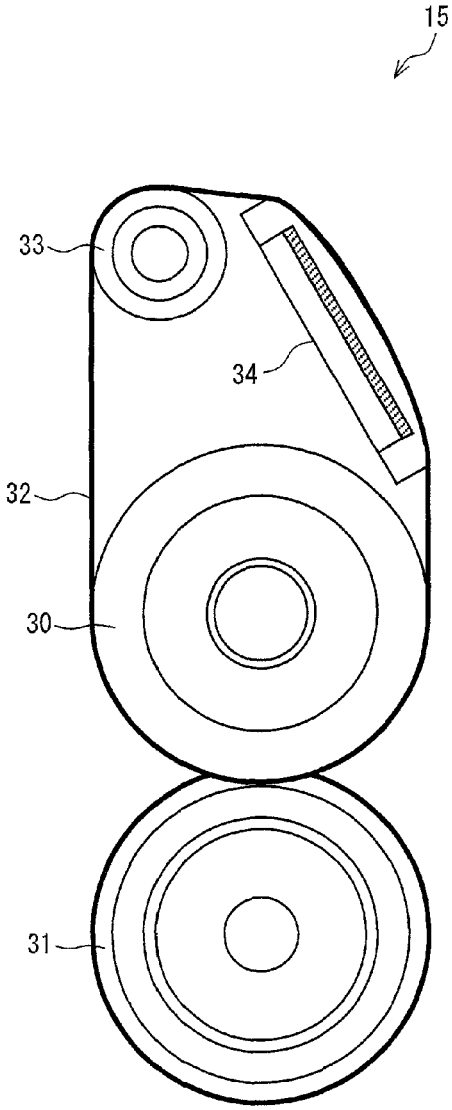
FIG. 5(*a*) is a view illustrating a fixing device in which a length of a fixing belt upstream of a fixing nip area in a fixing belt rotating direction, from a tension roller to a fixing member, is longer than that downstream of the fixing nip area in the fixing belt rotating direction, from the fixing member to the tension roller.
Figure 5:
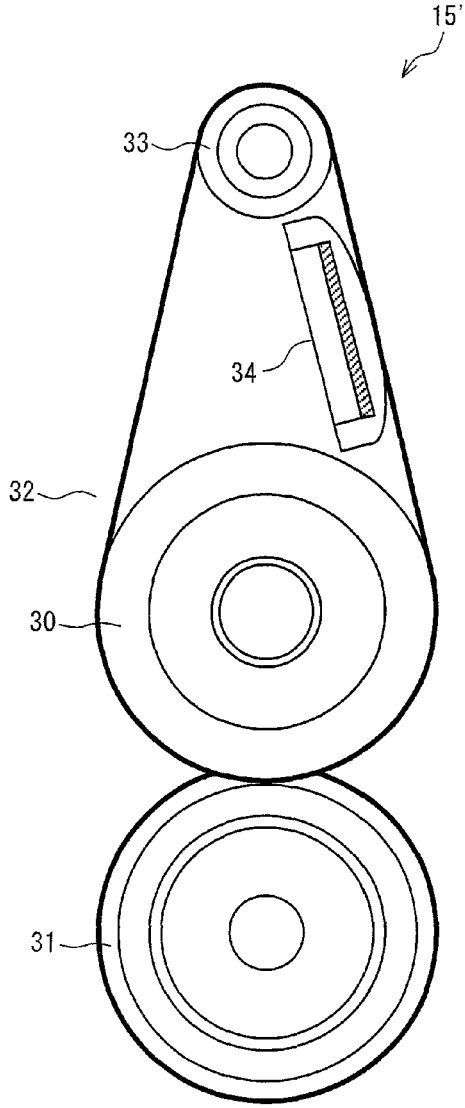

Moreover, as illustrated in FIG. 2, the tension roller 33 is determined in position on the fixing belt 32 provided across the fuser roller 30 and the tension roller 33, so that the length of the fixing belt 32 upstream of the fixing nip area N in the fixing belt 32 rotating direction is longer than that downstream of the fixing nip area N in the fixing belt 32 rotating direction. As understandable from the comparison between FIG. 5(*a*) and FIG. 5(*b*), it is possible to provide a space to dispose the heating member 34, on the upstream side of the fixing nip area N. This makes it possible to provide a wide heating nip width where the fixing belt 32 and the heating member 34 are pressured against each other. As a result, it is possible to efficiently heat the fixing belt 32. Moreover, by having the downstream side in the fixing belt 32 rotating direction be shorter than the upstream side, the distance in which the fixing belt 32 is cooled becomes short, thereby preventing the dispersion of heat.

As a result, the fixing unit 15 has excellent heat efficiency and low electricity consumption while preventing the occurrence of insufficient fixing.

Moreover, the fixing belt 32 is provided across the heating member 34, that is, the heating member 34 is in contact with the fixing belt 32 from the inner side of the fixing belt 32. This prevents the generation of scars on the outer circumferential surface of the fixing belt 32 that directly is in contact with the unfixed image on the recording paper P.

Moreover, by using a fixing belt 32 that has a small heat capacity, the heating member 34 having the resistance heating layer directly heats the fixing belt 32. This remarkably shortens the time required for warming up, which further allows remarkable reduction of the amount of electricity consumed by the fixing device.

Figure 4:
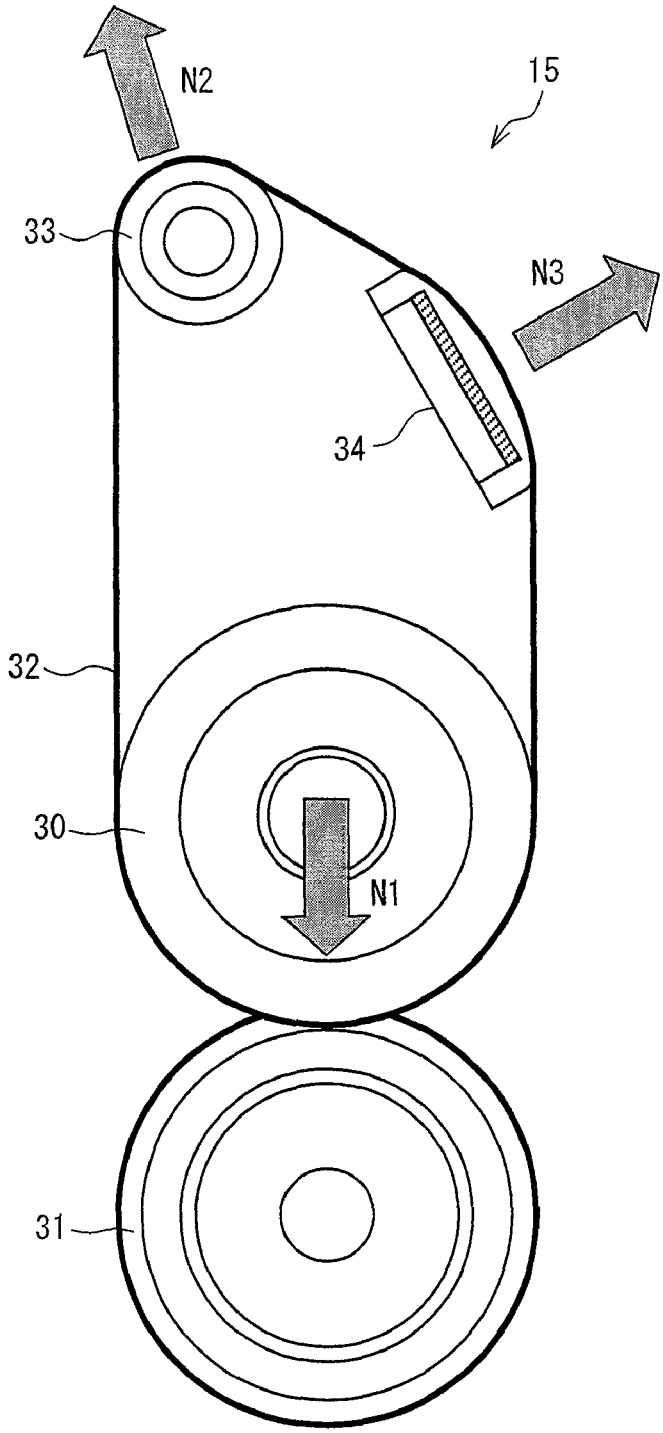
FIG. 4 is a view illustrating a load received by each of members in the fixing device.

As illustrated in FIG. 4, the fixing belt 32 is suspended by each of the fuser roller 30, the tension roller 33, and the pressure roller 31. Hence, when the fixing belt is provided in the tensioned state, a mechanical load is applied to each of the members. Moreover, the fuser roller receives pressure from the pressure roller. The fixing unit 15 is configured in such a manner that the following inequality is satisfied: N1>N2>N3, where N1 is a load received by the fuser roller from the pressure roller which applies pressure to the fuser roller, N2 is a load received when the tension roller 33 pulls the fixing belt 32, and N3 is a load received when the heating member 34 pulls the fixing belt 32 (when the heating nip is formed). The fixing unit 15 includes pressure applying means not illustrated, which applies an arbitrary load on each of the fuser roller, tension roller, and heating member.

In the relational expression N1>N2>N3, the load on the heat transfer member 346 of the heating member 34 is made most least, so it is possible to take measures to reduce weight and volume of the heat transfer member 346. By reducing the weight and volume, it is possible to reduce the heat capacity of the heat transfer member 346, and further reduce the flexure of the heat transfer member 346. Due to the reduction in heat capacity, the time required for warming up is shortened.

As such, in the present embodiment, the heat capacity of the heat transfer member 346 is reduced by reducing the weight and volume of the heat transfer member 346. By making the heat transfer member 346 lightweight and small in volume, the strength is also caused to decrease. Accordingly, the present embodiment is configured to have the load on the heat transfer member 346 be the least, that is, so that the relational expression N1>N2>N3 is satisfied. With other relational expressions (in a case where the load of N3 is greater), it is necessary to increase the size of the heat transfer member 346 in order to ensure the strength of the heating member 34. As a result, it is not possible to achieve the light weight or reduction of volume of the heat transfer member 346.

As such, by making the load received by the heating member 34 the least, it is possible to reduce the heat capacity of the heat transfer member 346, which therefore shortens the time required for warming up. For example, N1, N2, and N3 are to receive a load of 40 kg, 3.5 kg, and 1 kg, respectively, however the load to be received are not limited to these values.

(Configuration of Present Invention)

As described above, a fixing device of the present invention is a fixing device that causes an unfixed image provided on a recording material passing through a fixing nip area to be fixed onto the recording material, which fixing device includes a tension roller applying a load on the fixing belt from an inner circumferential side of the fixing belt, and is determined in position on the fixing belt so that a length of the fixing belt upstream of the fixing nip area in a fixing belt rotating direction, from the tension roller to the fixing member, is longer than that downstream of the fixing nip area in the fixing belt rotating direction, from the fixing member to the tension roller. In other words, the fixing belt provided across the fixing member and the tension roller is longer in length on its upstream side with respect to the fixing nip area in a fixing belt rotating direction than that of its downstream side with respect to the fixing nip area in the fixing belt rotating direction.

According to the configuration of the present invention, the fixing belt is provided across a fixing member, a heating member, and further a tension roller. Hence, it is possible to reduce the driving torque of the fixing belt and reduce the damage given to the fixing belt. Moreover, the tension roller is determined in position on the fixing belt so that a length of the fixing belt upstream of the fixing nip area in a fixing belt rotating direction, from the tension roller to the fixing member, is longer than that downstream of the fixing nip area in the fixing belt rotating direction, from the fixing member to the tension roller. Hence, a space to dispose a heating member can be secured on the upstream side of the fixing nip. This further allows having a wide heating nip width. Moreover, since the downstream side in the fixing belt rotating direction is shorter than its upstream side, the distance that the fixing belt becomes cooled is made shorter, thereby allowing prevention of heat dispersion. As a result, it is possible to efficiently heat the fixing belt.

As described above, the fixing device of the foregoing configuration has excellent heat conductivity and low electricity consumption while preventing the occurrence of poor fixing. Moreover, it is possible to attain reduction in the driving torque of the fixing belt and in damage received by the fixing belt.

Moreover, the fixing belt is provided across the heating member, that is, the heating member is in contact with the fixing belt from the inner circumferential side of the fixing belt. Hence, this prevents the generation of scars on the outer circumferential side of the fixing belt that directly is in contact with the unfixed image on the recording material, due to rubbing.

In addition to the foregoing configuration, it is preferable that the fixing device of the present invention satisfy the following inequality: $N1>N2>N3$, where N1 is a load received by the fuser roller from the pressure roller, N2 is a load received by the tension roller from the fixing belt, and N3 is a load received by the heating member from the fixing belt.

According to the configuration, the load applied on the heating member is made the least among the members that bridge the fixing belt. By having the load applied on the heating member as the smallest amount, it is possible to reduce the weight of the heat transfer member (supporting member) that supports the heating element included in the heating member. The reduction of weight results in the reduction in heat capacity of the heat transfer member; this allows shortening of time required for warming up.

In addition to the configuration, it is preferable that the fixing device of the present invention is configured in such a manner that the tension roller be made up of a core made of metal material whose outer surface is coated with heat insulating material.

This configuration allows appropriately providing tension to the fixing belt, and allows attainment of a fixing belt in which its heat is difficult to take away.

In addition to the configuration, it is preferable that the fixing device of the present invention is configured in such a manner that the heating member be disposed on an upstream side of the fixing nip area in the fixing belt rotating direction but on a downstream side of the tension roller in the fixing belt rotating direction.

According to the configuration, the heating member is provided on the upstream side of the fixing nip area in the fixing belt rotating direction however on the downstream side of the tension roller in the fixing belt rotating direction. This allows efficient conduction of heat of the heating member to the fixing member.

In addition to the configuration, the fixing device of the present invention may be configured in such a manner that the heating member include: a heating element; and a heat transfer member made of metal material, supporting the heating element and being in contact with the fixing belt on a surface on the inner circumferential side of the fixing belt.

In the foregoing configuration, use of a heat transfer member of a metal material having high thermal conductivity allows evenly heating the heating element. This makes it possible to evenly provide heat from the inner circumferential side of the fixing belt by the heat transfer member, in even heat distribution.

In addition to the configuration, the fixing device of the present invention may be configured in such a manner that the heat transfer member may have a coating layer provided on its surface with which the fixing belt is in contact.

According to the configuration, friction of the heat transfer member with the fixing belt is reduced by the coating layer; this improves the durability of the fixing belt. Furthermore, it is possible to reduce the driving torque, which as a result allows reduction of costs of driving parts such as a motor and the like.

In addition to the configuration, the fixing device of the present invention may be configured in such a manner that the surface of the heat transfer member with which surface the fixing belt is in contact is curved so as to protrude outwards, and a flat surface on the opposite side of the curved surface supports a sheet heater made up of (i) the heating element and (ii) insulators.

According to the configuration, the surface curved outwards of the heat transfer member allows bridging the fixing belt while holding down abrasion of the fixing belt, and can efficiently supply heat to the fixing belt. Further, by use of a sheet heater having a small heat capacity, it is possible to reduce the amount of electricity consumption.

Here, the sheet heater may be formed by having the heating element shaped as a sheet be sandwiched between the insulators each shaped as a sheet.

An image forming apparatus of the present invention includes any one of the fixing devices of the present invention. According to this configuration, it is possible to provide an image forming apparatus including a fixing device that has excellent heat efficiency and low electricity consumption while causing no poor fixing. Consequently, the image forming apparatus of the present invention is capable of forming a high quality image.

The present invention is not limited to the description of the embodiments above, but may be altered by a skilled person within the scope of the claims. An embodiment based on a proper combination of technical means disclosed in different embodiments is encompassed in the technical scope of the present invention.

INDUSTRIAL APPLICABILITY

The present invention is applicable to a fixing device provided in an image forming apparatus of an electrophotographic printing method such as a printer, a copying machine, a facsimile, and an MFP (Multi Function Printer), and moreover is applicable to the image forming apparatus.

REFERENCE SIGNS LIST

15 fixing unit (fixing device)
30 fuser roller (fixing member)
31 pressure roller (pressure member)
32 fixing belt
33 tension roller
34 heating member
35 heater lamp
36A,36B thermistor
100 image forming apparatus
340 sheet heating element
341 elastic layer
343 heating resistor
342,344 insulator
345 well heat-conducting layer
346 heat transfer member
347 coating layer
N fixing nip area
P recording paper
T toner

What is claimed is:

1. A fixing device comprising:
a rotatable fixing member;
a heating member;
an endless fixing belt, provided across the fixing member and the heating member in a tensioned state, the fixing belt (i) being rotated and (ii) being heated by the heating member;
a pressure member being pressed against the fixing member while having the fixing belt sandwiched between the pressure member and the fixing member, to form a fixing nip area at this pressured region together with the fixing belt, the fixing device fixing onto a recording material that passes through the fixing nip area an unfixed image formed on the recording material; and
a tension roller applying a load on the fixing belt from an inner circumferential side of the fixing belt, wherein
the tension roller is determined in position on the fixing belt so that a length of the fixing belt upstream of the fixing nip area in a fixing belt rotating direction, from the tension roller to the fixing member, is longer than that downstream of the fixing nip area in the fixing belt rotating direction, from the fixing member to the tension roller, and
the following inequality is satisfied:

$$N1>N2>N3,$$

where N1 is a load received by the fuser roller from the pressure roller, N2 is a load received by the tension roller from the fixing belt, and N3 is a load received by the heating member from the fixing belt.

2. The fixing device according to claim 1, wherein the tension roller is made up of a core made of metal material whose outer surface is coated with heat insulating material.

3. The fixing device according to claim 1, wherein the heating member is disposed on an upstream side of the fixing nip area in the fixing belt rotating direction but on a downstream side of the tension roller in the fixing belt rotating direction.

4. The fixing device according to claim 1, wherein the heating member comprises:
a heating element; and
a heat transfer member made of metal material, supporting the heating element and being in contact with the fixing belt on a surface on the inner circumferential side of the fixing belt.

5. The fixing device according to claim 4, wherein the heat transfer member has a coating layer provided on its surface with which the fixing belt is in contact.

6. The fixing device according to claim 4, wherein the surface of the heat transfer member with which surface the fixing belt is in contact is curved so as to protrude outwards, and a flat surface on the opposite side of the curved surface supports a sheet heater made up of (i) the heating element and (ii) insulators.

7. The fixing device according to claim 6, wherein the sheet heater is formed by having the heating element shaped as a sheet be sandwiched between the insulators each shaped as a sheet.

8. An image forming apparatus comprising a fixing device as set forth in claim 1.

* * * * *